US006099092A

United States Patent [19]

Uffner et al.

[11] Patent Number: 6,099,092

[45] Date of Patent: Aug. 8, 2000

[54] STORAGE CABINET CAM-SHAPED LOCKING ARRANGEMENT

[75] Inventors: Michael G. Uffner, Naperville; Jed C. Richardson, Batavia, both of Ill.

[73] Assignee: Suncast Corporation, Batavia, Ill.

[21] Appl. No.: 09/433,464

[22] Filed: Nov. 4, 1999

[51] Int. Cl.[7] ..... A47B 87/00; E05D 11/06

[52] U.S. Cl. ..... 312/108; 312/263; 16/374

[58] Field of Search ..... 312/107, 108, 312/111, 257.1, 263, 265.5, 209, 265.2, 400, 405, 326, 329; 49/399; 16/374, 371, 331, 332

[56] References Cited

U.S. PATENT DOCUMENTS

| | | | |
|---|---|---|---|
| 2,483,606 | 10/1949 | Albach et al. | 312/329 X |
| 2,722,468 | 11/1955 | Perrin | 312/265.2 |
| 2,999,730 | 9/1961 | Troutman | 312/265.2 |
| 4,201,428 | 5/1980 | Johnson | 312/108 X |
| 4,691,644 | 9/1987 | Frydman | 312/265.5 X |
| 5,221,131 | 6/1993 | Lesperance et al. | 312/263 |
| 5,368,380 | 11/1994 | Mottmiller et al. | 312/111 X |
| 5,372,415 | 12/1994 | Tisbo et al. | 312/263 X |
| 5,466,058 | 11/1995 | Chan | 312/263 X |
| 5,499,428 | 3/1996 | Okada | 16/374 X |
| 5,605,344 | 2/1997 | Insalaco et al. | 312/209 X |
| 5,931,553 | 8/1999 | Cohen | 312/108 X |

FOREIGN PATENT DOCUMENTS

| | | | |
|---|---|---|---|
| 67122 | 12/1982 | European Pat. Off. | 16/374 |

*Primary Examiner*—Peter M. Cuomo
*Assistant Examiner*—James O. Hansen
*Attorney, Agent, or Firm*—Welsh & Katz, Ltd.

[57] ABSTRACT

A locking arrangement for a cabinet, the cabinet having a top panel, a base panel, and at least one pivoting door panel, with the panels connected to one another to define an internal storage region, includes a cam-shaped projection formed on one of the hinge element and the corresponding side pane. The cam has first and second surfaces formed contiguous with the respective one of the hinge element and the corresponding side panel, and a retaining member formed on the other of the hinge element and the corresponding side panel. The retaining member has a recess formed therein. The cam-shaped projection and the retaining member frictionally cooperate with one another to maintain the door panel in the closed position with the cam-shaped projection engaged in the recess. The cam-shaped projection further maintains the door in an at least partially opened position when the cam-shaped projection is disengaged from the recess, in contact with the retaining member.

13 Claims, 5 Drawing Sheets

STORAGE CABINET CAM-SHAPED LOCKING ARRANGEMENT

FIELD OF THE INVENTION

This invention pertains to locking hinges for cabinets. More particularly, the invention pertains to cabinets with cam-shaped catches molded into structural panels.

BACKGROUND OF THE INVENTION

Cabinets, and more particularly, storage cabinets can be found in every commercial enterprise and residence. These cabinets range from modern, sleek, custom-made cabinets, to "older" kitchen cabinets subsequently hung in a basement, laundry room or a garage to provide additional storage space.

While the requirements for these cabinets and the environment to which they may be subjected vary widely, they all must be able to contain whatever is stored within them. But the usefulness of a cabinet is not solely a function of its ability to contain stored items. Ease of placing items in and removing items from a cabinet is also important to the usefulness of a cabinet. The ease of placing items in and removing items from a cabinet is affected by how easily a cabinet door is opened or closed and by whether an open cabinet door will remain open. Further, the storing function of a cabinet is substantially aided if the cabinet door is maintained in a closed condition when the interior is not being accessed.

The doors of cabinets are often controlled with a variety of catches. One known catch is a clip-type catch that includes a clip or roller attached to the cabinet that accepts a tongue attached to the door. The clip-type catches maintain a door in a closed position with a combination of adaptive fit and friction between the parts. Such catches usually require some force to close the door completely, and can prevent the door from closing completely if the door is not forced to complete closure.

Magnetic catches that use a magnet on the cabinet and a metal plate on the door are often used. Such magnetic catches maintain doors in the closed position and help to close doors by the attraction of the magnet and the plate. On the other hand, a door with magnetic catches can undesirably close completely if the cabinet is not level or if environmental conditions, such as wind, place the door in a nearly closed position.

A variation of magnetic catch spring-loads the magnet so that pressing the cabinet door triggers a spring that impels the door into an open position. Such spring-loaded magnetic catches must be firmly closed completely in order to retension the spring, and do not solve the problem of the unwanted closing of the door by the attraction of the door to the cabinet.

Both the clip-type and magnetic catches usually require parts that are not integral to the body of the cabinet itself. These additional parts must be manufactured or purchased, and then installed on the cabinet. Further, these additional parts may themselves have moving parts that may fail through extended use or unfavorable environmental conditions. Similarly, kitchen cabinets often have multi-part hinges that must be separately manufactured and installed in the cabinet.

Accordingly, there exists a need for a cabinet having a catch that facilitates easy opening and closing of the cabinet. Desirably, such catches maintain doors open or closed, as desired. Advantageously, in addition to maintaining doors in an open or closed condition, the configuration of the catches actively aids complete opening and closing of the cabinet door. Most preferably, such a cabinet has the catches present as an integral part of the cabinet.

SUMMARY OF THE INVENTION

A locking arrangement for a cabinet, where the cabinet has a top panel, a base panel, and at least one pivoting door panel, with the panels connected to one another to define an internal storage region, includes a hinge pintle connecting at least one pivoting door panel to a corresponding side panel and the top and base panels. Such a locking arrangement also has a hinge element formed as part of at least one door panel. The hinge element is configured to receive the hinge pintle and pivot thereabout between an opened position and a closed position.

A cam-shaped projection is formed on one of the hinge elements and the corresponding side panel. The cam has first and second surfaces formed contiguous with the respective one of the hinge elements and the corresponding side panel. The locking arrangement also includes a retaining member formed on the other of the hinge elements and the corresponding side panel. The retaining member has a recess formed therein.

In such a locking arrangement, the cam-shaped projection and the retaining member frictionally cooperate with one another to maintain the door panel in the closed position with the cam-shaped projection engaged in the recess, and the cam-shaped projection maintains the door in an at least partially opened position when the cam-shaped projection is disengaged from the recess, in contact with the retaining member.

In a preferred embodiment the first and second surfaces are bridged by an arcuate apex, and more preferably, the arcuate apex is a radial apex.

In another embodiment the door panel has an exterior, and the first surface is preferably disposed at an angle of about 15° to 55° relative to the exterior, more preferably at an angle of about 25° to 45°, and most preferably at an angle of about 35° relative to the exterior.

In yet a further embodiment the door panel has an exterior, and the second surface is disposed at an angle of about 50° to 90° relative to the exterior, more preferably at an angle of about 60° to 80°, and most preferably at an angle of about 70°.

In still another embodiment, the first and second surfaces are disposed at an angle of about 50° to 100° relative to each other, more preferably at an angle of about 60° to 80°, and most preferably at an angle of about 70° relative to each other.

In still another embodiment, the retaining element has a reinforcing rib. In yet another embodiment, the retaining element is a rectangular strip. In yet still another embodiment, the reinforcing rib is a rectangular bar, oriented parallel to the hinge element, formed on the retaining member, adjacent to the recess.

These and other features and advantages of the present invention will be apparent from the following detailed description, the accompanying drawings and the appended claims.

DETAILED DESCRIPTION OF THE PREFERRED EMBODIMENTS

Figure 1:
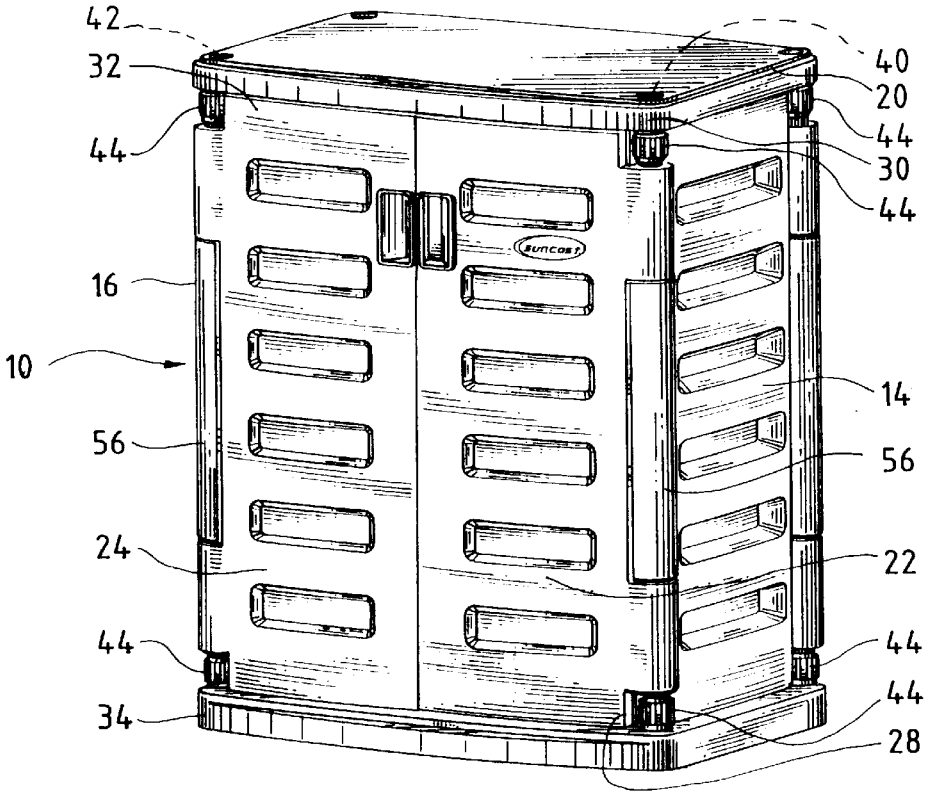
FIG. 1 illustrates a front perspective view of a closed cabinet having catches that embody the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. Except as otherwise disclosed herein, the details of the preferred embodiment of the non-catch aspects of the cabinet are disclosed in U.S. Pat. No. 5,975,660 to Tisbo et al, which patent is commonly assigned herewith, and which is incorporated by reference herein.

Figure 2:
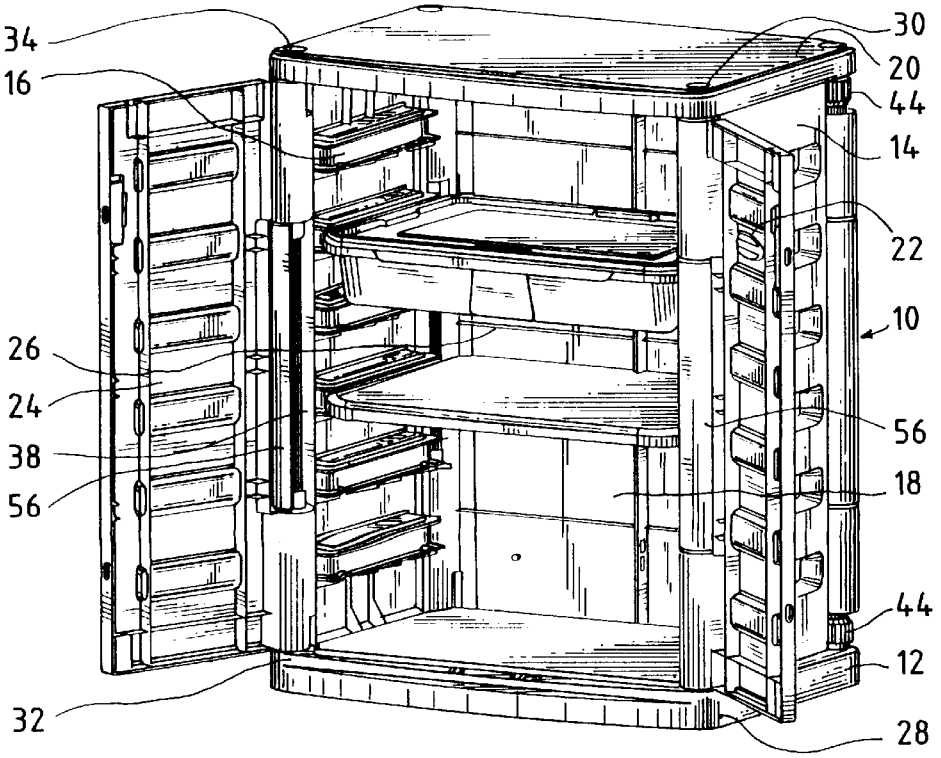
FIG. 2 illustrates the cabinet of FIG. 1 with the doors open.

Referring now to the figures and particularly to FIGS. 1–2, there is shown a cabinet 10 embodying the principles of the present invention. The cabinet 10 includes a base panel (or base) 12 that is preferably substantially rectangular. Opposingly oriented side panels 14, 16 extend upwardly from the base 12 abutting a rear panel 18 section that is secured to the base 12 and the side panels 14, 16 to define a top panel (or top) 20. The illustrated cabinet 10 has a pair of outwardly pivotal front door panels 22, 24 extending between the side panels 14, 16. The base 12 is generally rectangular in shape, having slightly outwardly arched sides. This can also be the overall shape of the sides 14, 16, rear panel 18, the top 20 and door panels 22, 24. When assembled, the top 20, base 12, rear panel 18, side panels 14, 16, and door panels 22, 24 define an internal storage region 26.

Figure 3:
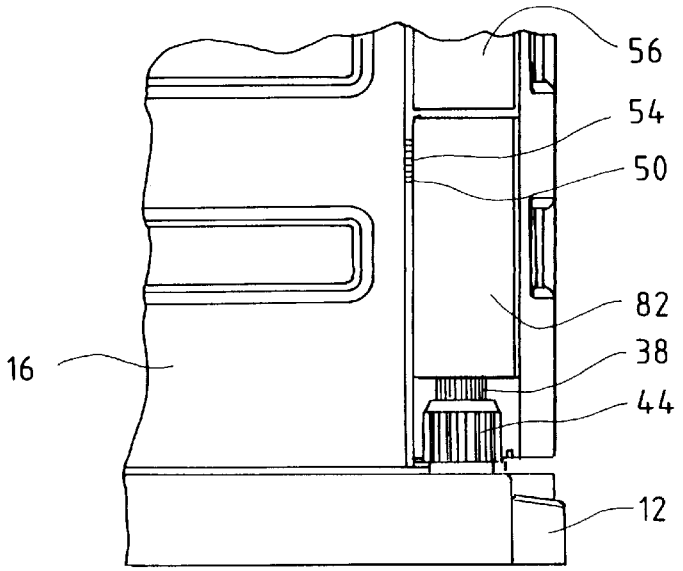
FIG. 3 illustrates an exterior corner of a the cabinet.
Figure 4:
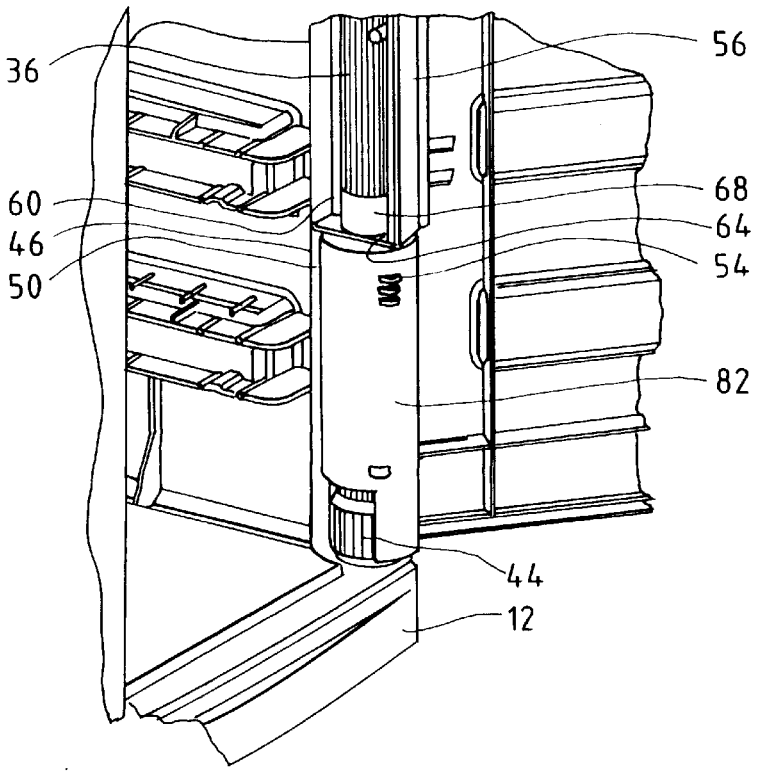
FIG. 4 is an interior view of a corner of the cabinet of FIG. 1.

The cabinet 10 defines corners 28, 30, 32, 34, shown in FIGS. 3–4, where the side panels 14, 16 meet the door panels 22, 24 at the top 20 or the base 12. Hinge pintles 36, 38 for the cabinet 10 extend between corners 28, 30, 32, 34 along edges 40, 42 of the cabinet 10 where the door panels 22, 24 and the side panels 14, 16 meet. Preferably, these hinge pintles 36, 38 also serve as support posts to structurally reinforce the cabinet 10. The door panels 22, 24 pivot on the hinge pintles 36, 38 which are supported by the side panels 14, 16 clamping members 44 on the top 20 or base 12, or all of the above.

The catches for the cabinet 10 operate through cooperation of the side panels 14, 16 and the door panels 22. 24. The side panels 14, 16 each have retaining members 46, 48 formed in the side panels 14, 16 which define cam recesses 50, 52. The door panels 22, 24 have cam shaped projections (or cams) 54 formed on at least one of the hinge elements 80, 82. When the door panels 22, 24 are in a closed position (or condition), the retaining members 46, 48 maintain the cam shaped projections 54 in the recesses 50, 52. Similarly, when the door panels 22, 24 are in an open position (or condition) the cams 54 are not lodged in or freed from the recesses 50, 52.

Figure 5:
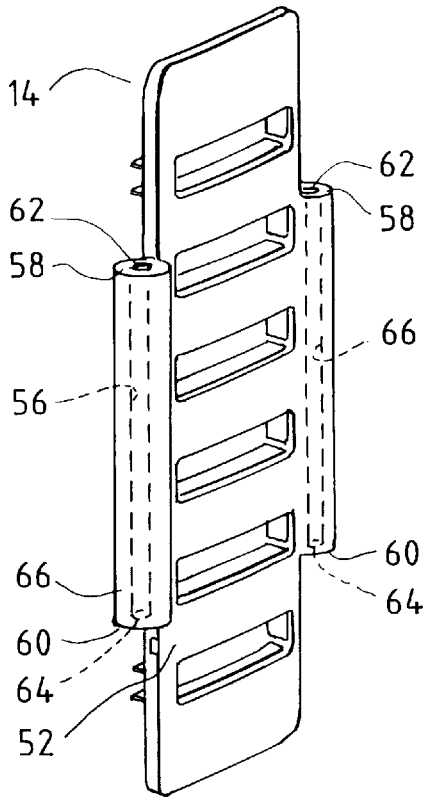
FIG. 5 depicts an exemplary side panel of the cabinet of FIG. 1.

An exemplary side panel is shown in FIG. 5. Preferably, each side panel 14, 16 is generally rectangular. Each side panel 14, 16 has a hinge supporting member 56 which extends along the edge of each side panel 14, 16 so as to abut the adjacent door panel 22, 24. Preferably, each hinge supporting member 56 is an upright cylindrical sleeve having a top end 58 and a bottom end 60 spaced from the top 20 and the base 12 respectively. Preferably, the top end 58 and the bottom end 60 present relatively smooth faces 62, 64 in planes generally parallel to the top 20 and base 12 of the cabinet 10, respectively.

As shown in FIG. 4, each hinge supporting member 56 defines a pintle accepting passage 66 for accepting the hinge pintle 36, 38. Preferably, the pintle accepting passage 66 is defined by collars 68 at the top end 58 and bottom end 60 of the hinge supporting member 56, which are cylinders sized to accept the hinge pintles 36, 38.

Figure 6A:
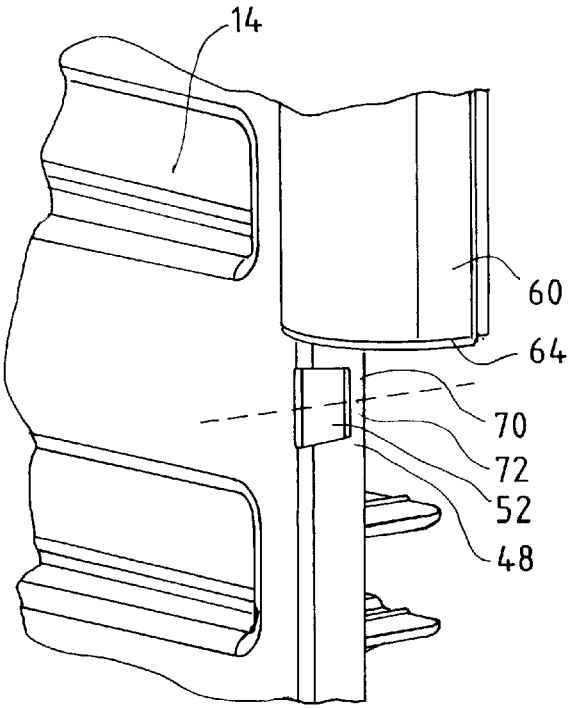
FIG. 6*a* is an enlarged perspective view of the exemplary side panel of FIG. 5.
Figure 6B:
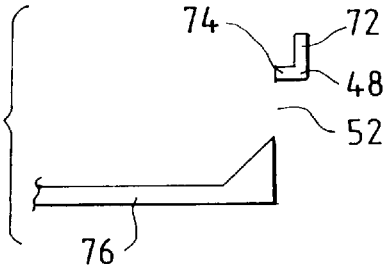
FIG. 6*b* is a partial cross-section of a exemplary side panel.

As illustrated in FIGS. 6*a* and *b*, each side panel 14, 16 also has a retaining member 46, 48 located between the hinge supporting member 56 and the top 20 or base 12 of the cabinet 10 respectively. Preferably, as shown in FIG. 6*b*, the retaining member 48 is a rectangular strip 72 with a reinforcing rib 74. More preferably, the reinforcing rib 74 is formed to allow the cam 54 to pass freely over the retaining member 46, 48. In this embodiment a rectangular bar is formed adjacent to the recess 50, 52 on the side of the rectangular strip 72 that faces away from the hinge element 80, 82, and is oriented parallel to the hinge element 80, 82. In addition, each side panel 14, 16 defines a recess 50, 52 adjacent to the retaining member 46, 48. Preferably, the reinforcing rib 74 is also adjacent to the recess 50, 52. The recess 50, 52 can be formed as a hole in the side panel 14, 16, preferably trapezoidal in shape, with the longer of the parallel sides adjacent to the exterior of the side panel 14, 16.

Figure 7:
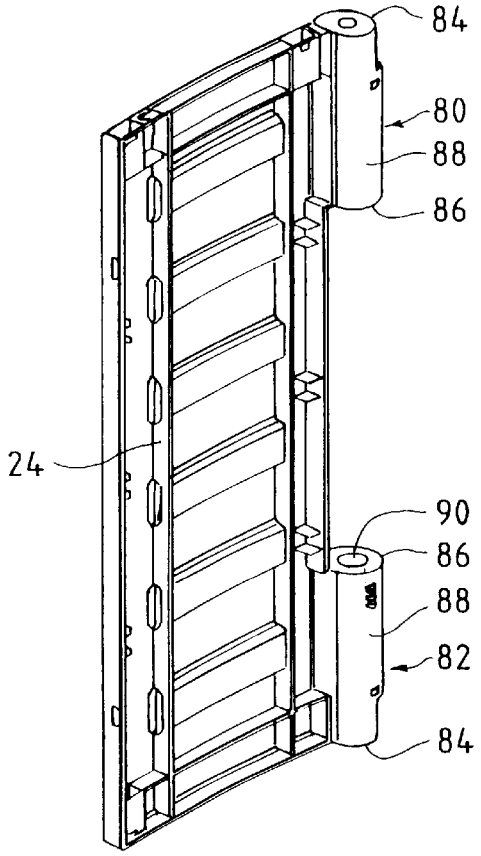
FIG. 7 illustrates an exemplary door panel.

An exemplary door panel is shown in FIG. 7. Preferably, each door panel 22, 24 is generally rectangular. Each door panel 22, 24 presents an exterior surface 76 on the outside 78 of the cabinet 10. Each door panel defines at least one hinge element 80, 82. As seen in FIG. 7, top and bottom hinge elements 80, 82 are preferably spaced from each other and occupy the space between the hinge supporting members 56 and the top 20 and the base 12 of the cabinet 10 when the cabinet is constructed.

Figure 8:
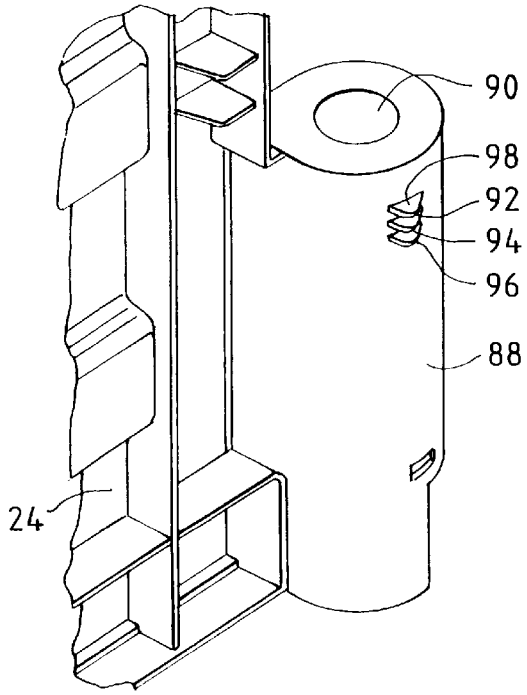
FIG. 8 is enlarged perspective of the exemplary door panel of FIG. 1.

FIG. 8 shows the details of preferred hinge elements 80, 82. Each hinge element 80, 82 presents a partial cylinder 88 formed as part of the respective side panel 14, 16. Preferably, each hinge element 80, 82 is approximately a three-quarters cylinder (or partial cylinder) 88 formed on the door panel 22, 24 with the partial cylinder 88 tangential to the exterior surface 76. Preferably, the long axis of the partial cylinder 88 extends transverse to the base 12 and the top 20 of the cabinet 10.

Each hinge element 80, 82 has an exterior end 84 and an interior end 86. The exterior end 84 of each hinge element

80, 82 abuts the top 20 or base 12 of the cabinet 10, respectively. Preferably, the exterior end 84 of each hinge element 80, 82 is spaced from the top 20 or base 12 respectively. Each interior end 86 of each hinge element 80, 82 presents a relatively smooth surface generally parallel to the top end 58 and bottom end 60 of the hinge supporting member 56, respectively.

Each hinge element 80, 82 defines a cylindrical passage 90 in the center of the hinge element 80, 82 to accept the hinge pintle 36, 38. Preferably, the cylindrical passage 90 is sized to frictionally engage the hinge pintle 36, 38 gently such that gravity will not move the pintle 36, 38 relative to the cylindrical passage 90, but that gentle manual manipulation will suffice.

Each hinge element 80, 82 also has a cam-shaped projection, or cam, 54 on the exterior of the hinge element 80, 82 preferably positioned on the opposite side of the partial cylinder 88 from where the partial cylinder 88 meets the exterior surface 76. Preferably, the cam-shaped projection 54 presents an arcuate bulge or protrusion extending from the surface of the partial cylinder 88. In the illustrated embodiment, each cam 54 has three spaced sheets 92, 94, 96 (top, middle, and bottom) which are parallel to each other and are connected to one another by a reinforcing rib or leaf 98. The reinforcing leaf 98 is a sheet that extends generally outwardly from the partial cylinder 88 and extends between and connects adjacent sheets 92, 94, 96.

Figure 9:
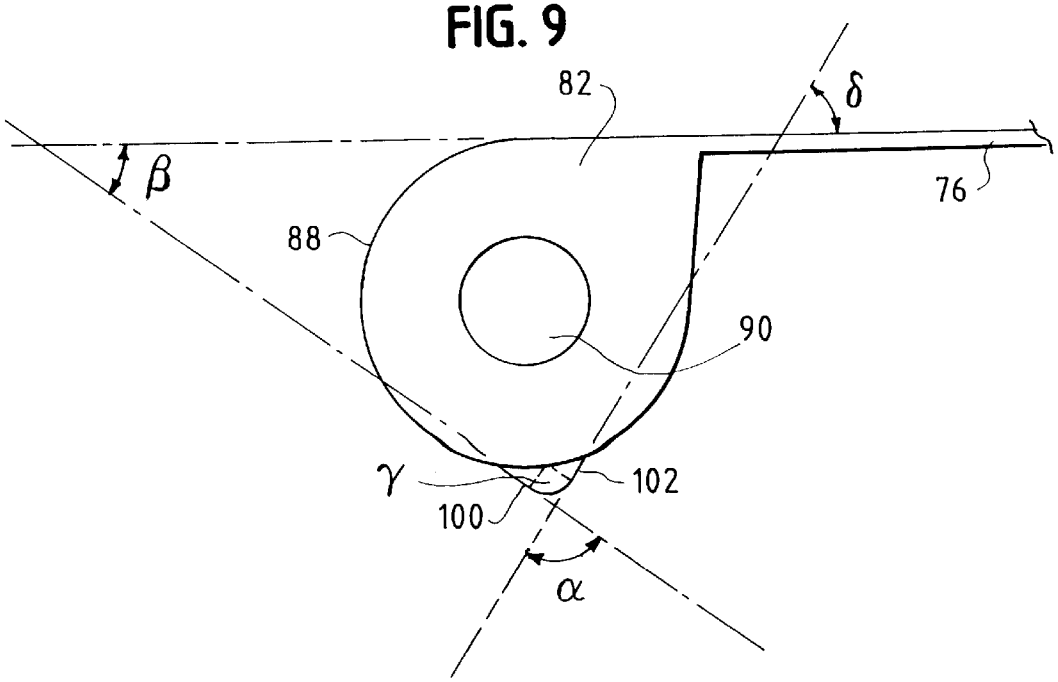
FIG. 9 is a top view of a hinge element.

Referring to FIG. 9, each cam 54 presents first and second surfaces 100, 102 which are, in a current embodiment, formed at an angle $\alpha$ of 50° to 100° to each other, preferably at an angle of 60° to 80°, and most preferably at an angle of almost 75° to each other. The first surface 100 is a closing surface, and faces generally outwardly, away from the center of its door panel. The angle $\beta$ between the exterior of the door panel and the general plane of the first surface is about 15° to 55°, preferably about 25° to 45°, and most preferably about 35°.

The second surface 102 is a retaining surface, (which also provides an opening surface or a closing completion surface) that faces generally inwardly toward the center of its door panel. The second surface 102 serves as a retaining surface to maintain the door in a closed condition. The second surface 102 also acts as an opening surface to urge the retaining member 46, 48 aside during opening. The second surface 102 further acts as a closing completion surface during closing in that the retaining member 46, 48 will urge an almost-closed door into the closed condition at the second surface 102. The angle $\delta$ between the exterior of the door panel and a plane of the second surface is preferably about 50° to 90°, more preferably 60° to 80°, and most preferably about 70°.

Preferably, the first and second surfaces 100, 102 are bridged by an arcuate or radial apex. More preferably, the curvature of the arcuate or radial apex has a focus approximately at the surface of the cylinder, illustrated by y.

Referring to FIG. 2, the top 20 and base 12 each have clamping members 44 in the corners 28, 30, 32, 34 of the cabinet 10. The clamping members 44 secure the hinge pintles 36, 38 which extend from the top 20, through the top hinge element 80, the hinge supporting member 56, the bottom hinge element 80, 82, and to the clamping member 44 on the base 12. The hinge pintle 36, 38 is a generally cylindrical member, preferably made of plastic-sheathed steel.

As will be apparent to those skilled in the art, the hinge pintles 36, 38 can be secured by a variety of other ways, such as clamps in the side panels, or secured with a disk-like head. All such variations are contemplated by the present invention.

A preferred embodiment of the invention has a freely rotatable ring surrounding the hinge pintle between the hinge element and the clamping members 44 to reduce friction during opening.

Referring now to FIG. 4, the side 14, 16 and door panels 22, 24 join to one another at corners 28, 30, 32, 34, in this illustration near the base 12. A clamping member 44 and a collar 68 cooperate to hold the hinge pintle 36, 38 into place along an edge 40, 42 of the cabinet 10. The hinge element 80, 82 of a door panel 22, 24 fits in the space above the clamping member 44 and below the bottom end 60 of the hinge supporting member 56, and surrounds the hinge pintle 36, 38. The cam 54 on the door panel 22, 24 is disposed so that as the door panel 22, 24 closes the cam 54 will lodge in the recess 50, 52.

A door panel 22, 24 is in an open position (or condition) when the cam 54 is lodged in the recess 50, 52 that is along the inside of the retaining member 44, 46. Similarly, when the cam 54 is located on the outside of the retaining member 44, 46 the door panel is in an open condition. The door panel 22, 24 is closing or opening when a door panel 22, 24 and a cam 54 are in urging relationship to each other. Because the cam 54 and the retaining member 46, 48 must come into urging relationship with each other in order to open or close the door panel 22, 24, the catch will maintain an open door opened and a closed door closed.

Figure 10:
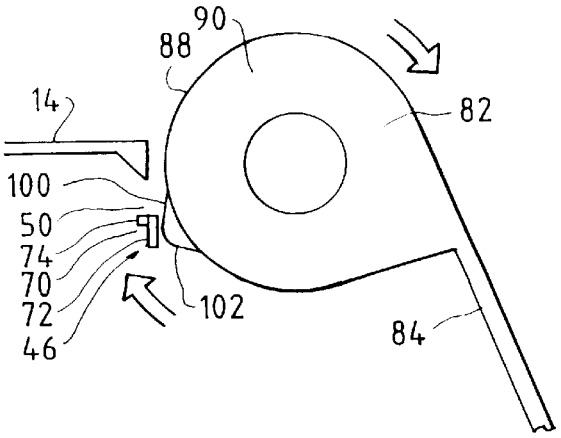
FIG. 10 illustrates a catch at the beginning of urging the door to close.
Figure 11:
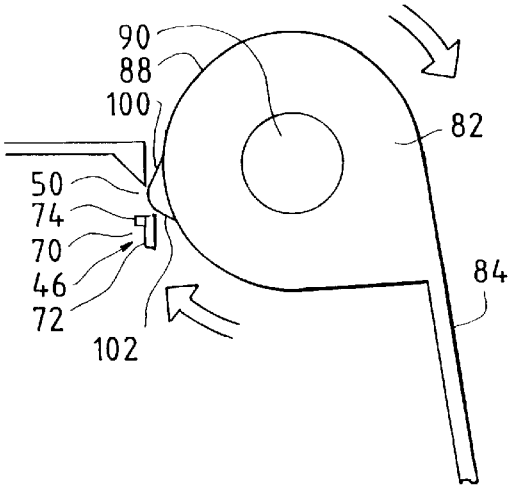
FIG. 11 illustrates the catch of FIG. 10 as the door is closing.
Figure 12:
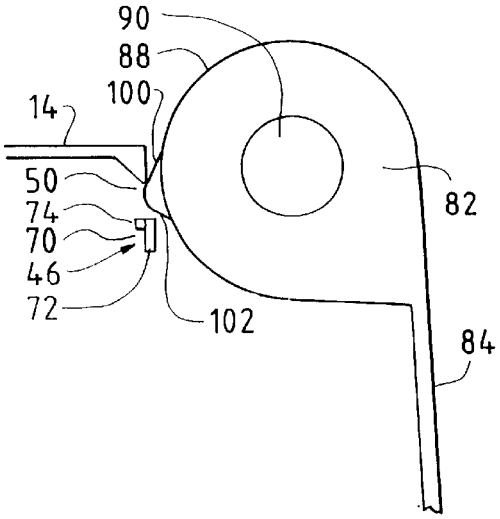
FIG. 12 shows a catch with the door in the closed position.

FIGS. 10–15 illustrate the interaction of the side panels 14, 16 and the cams 54 as the door panel 22, 24 closes and opens. As the door panel 22, 24 closes, the first surface 100 urges the retaining member 46, 48 away from the hinge element 80, 82, as shown in FIG. 10. After the first surface 100 passes over the retaining member 46, 48, the second surface 102 engages the retaining member 46, 48, as shown in FIG. 11. Then the retaining member 46, 48 urges the door panel 22, 24 into the closed position by applying force to the second surface 102. As can be seen in FIG. 9, the second surface 102 of the cam 54 preferably presents a steeper surface relative to the hinge element 80, 82 than the first surface 100 does. This steeper surface allows the retaining member 46, 48 to quickly return to the position that the cam urged it from, providing a snap action during closing. This snap action completes the closing of the door panel 22, 24 and also provides an audible indication of the closing of the door panel 22, 24. As can be seen in FIG. 12, the retaining member 46, 48 and reinforcing rib 74 are positioned to abut the second surface 102 when the door panel 22,24 is closed, maintaining the door panel 22, 24 in a closed position.

Figure 13:
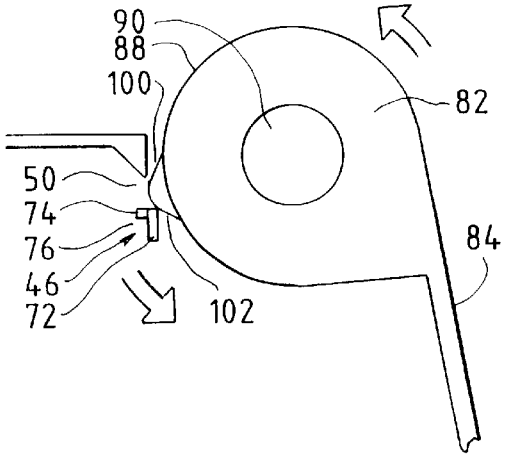
FIG. 13 shows a catch with the door beginning to open.
Figure 14:
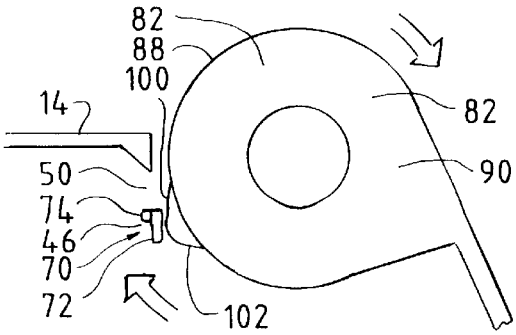
FIG. 14 shows a catch with the door almost open sequentially following the illustration of FIG. 13.
Figure 15:
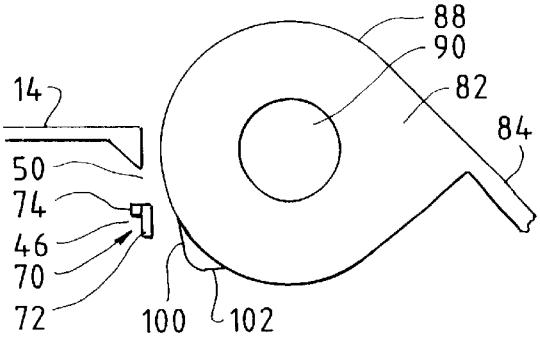
FIG. 15 shows a catch when the door in an open position.

When the door panel 22, 24 is opened, the second surface 102 urges the retaining member 46, 48 away from the hinge element 80, 82, as seen in FIG. 13. After the second surface 102 passes over the retaining member 46, 48, the first surface 100 engages the retaining member 46, 48, as seen in FIG. 14. Then the retaining member 46, 48 urges the door panel 22, 24 into an open position by applying force to the first surface 100. Preferably, the opening of the door panel 22, 24 does not provide a snap action with an audible indication. The lack of a snap action is achieved when the first surface 100 presents a shallow angle to the retaining member 46, 48 during opening, thereby slowing the return action of the retaining member 46, 48.

What is claimed is:

1. A locking arrangement in a cabinet, the cabinet having a top panel, a base panel, at least one pivoting door panel, the panels connected to one another to define an internal storage region, the locking arrangement comprising:

a hinge pintle connecting at least one pivoting door panel to a corresponding side panel and the top and base panels;

a hinge element formed as part of at least one door panel, the hinge element configured to receive the hinge pintle and pivot thereabout between an opened position and a closed position;

a cam-shaped projection formed on one of the hinge element and the corresponding side panel, the cam having first and second surfaces formed contiguous with the respective one of the hinge element and the corresponding side panel; and a retaining member formed on the other of the hinge element and the corresponding side panel, the retaining member having a recess formed therein, wherein the cam-shaped projection and the retaining member frictionally cooperate with one another to maintain the door panel in the closed position with the cam-shaped projection engaged in the recess, and wherein the cam-shaped projection maintains the door in an at least partially opened position when the cam-shaped projection is disengaged from the recess, in contact with the retaining member.

2. A locking arrangement as in claim 1, wherein the first and second surfaces are bridged by an arcuate apex.

3. A locking arrangement as in claim 2, wherein the arcuate apex is a radial apex.

4. A locking arrangement as in claim 1, wherein the door panel has an exterior, and the first surface is disposed at an angle of about 15° to 55° relative to the exterior.

5. A locking arrangement as in claim 1, wherein the door panel has an exterior, and the first surface is disposed at an angle of about 35° relative to the exterior.

6. A locking arrangement as in claim 1, wherein the door panel has an exterior, and the second surface is disposed at an angle of about 50° to 90° relative to the exterior.

7. A locking arrangement as in claim 1, wherein the door panel has an exterior, and the second surface is disposed at an angle of about 70° relative to the exterior.

8. A locking arrangement as in claim 1, wherein the first and second surfaces are disposed at an angle of about 50° to 100° relative to each other.

9. A locking arrangement as in claim 1, wherein the first and second surfaces are disposed at an angle of about 70° relative to each other.

10. A locking arrangement as in claim 1, wherein the retaining element has a reinforcing rib.

11. A locking arrangement as in claim 13, wherein the reinforcing rib is a rectangular bar, oriented parallel to the hinge element, formed on the retaining member, adjacent to the recess.

12. A locking arrangement as in claim 1, wherein the retaining element is a rectangular strip.

13. A locking arrangement in a cabinet, the cabinet having a top panel, a base panel, at least one pivoting door panel, the panels connected to one another to define an internal storage region, the locking arrangement comprising:

a hinge pintle connecting at least one pivoting door panel to a corresponding side panel and the top and base panels;

a hinge element formed as part of at least one door panel, the hinge element configured to receive the hinge pintle and pivot thereabout between an opened position and a closed position;

a cam-shaped projection formed on one of the hinge element and the corresponding side panel, the cam having first and second surfaces formed contiguous with the respective one of the hinge element and the corresponding side panel, the first and second surfaces being bridged by an arcuate apex; and a rectangular strip having a reinforcing rib formed on the other of the hinge element and the corresponding side panel, the retaining member having a recess formed therein, wherein the cam-shaped projection and the retaining member frictionally cooperate with one another to maintain the door panel in the closed position with the cam-shaped projection engaged in the recess, and wherein the cam-shaped projection maintains the door in an at least partially opened position when the cam-shaped projection is disengaged from the recess, in contact with the retaining member and wherein the door panel has an exterior, the first surface being disposed at an angle of about 15° to 55° relative to the exterior, the second surface being disposed at an angle of about 50° to 90° relative to the exterior, and the first and second surfaces being disposed at an angle of about 50° to 100° relative to each other.

* * * * *